US012150615B2

(12) United States Patent
Lee et al.

(10) Patent No.: US 12,150,615 B2
(45) Date of Patent: Nov. 26, 2024

(54) VACUUM CLEANER

(71) Applicant: LG ELECTRONICS INC., Seoul (KR)

(72) Inventors: Jung Woo Lee, Seoul (KR); Jung Bae Hwang, Seoul (KR); Phil Jae Hwang, Seoul (KR); Chi Wan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 221 days.

(21) Appl. No.: 17/791,565

(22) PCT Filed: Nov. 19, 2020

(86) PCT No.: PCT/KR2020/016364
§ 371 (c)(1),
(2) Date: Jul. 8, 2022

(87) PCT Pub. No.: WO2021/145550
PCT Pub. Date: Jul. 22, 2021

(65) Prior Publication Data

US 2023/0029769 A1 Feb. 2, 2023

(30) Foreign Application Priority Data

Jan. 15, 2020 (KR) ..... 10-2020-0005625

(51) Int. Cl.
*A47L 9/04* (2006.01)
*A46B 13/00* (2006.01)
(Continued)

(52) U.S. Cl.
CPC ..... *A47L 9/0477* (2013.01); *A46B 13/005* (2013.01); *A46B 13/02* (2013.01);
(Continued)

(58) Field of Classification Search
CPC ..... A47L 9/0477; A47L 9/0411; A47L 9/04; A47L 9/0461
(Continued)

(56) References Cited

U.S. PATENT DOCUMENTS 9,924,843 B2 * 3/2018 Song ..... A47L 9/2857
11,324,366 B2 * 5/2022 Kim ..... A47L 9/0477
(Continued)

FOREIGN PATENT DOCUMENTS

CN 209574555 U 11/2019
CN 110623595 A 12/2019
(Continued)

OTHER PUBLICATIONS

WO-0141618-A1 espacenet (Year: 2024).*

*Primary Examiner* — Brian D Keller
*Assistant Examiner* — Tim Brady
(74) *Attorney, Agent, or Firm* — Birch, Stewart, Kolasch & Birch, LLP

(57) ABSTRACT

A vacuum cleaner is disclosed. The vacuum cleaner according to embodiments of the present disclosure includes a main body and a suction nozzle. The suction nozzle includes a housing, a button, a rotating brush, and a detachable cover. The housing includes an insertion hole. The button includes a first protrusion. The detachable cover includes a cover body and a slider. The cover body includes an insertion member, a second protrusion, and a rail. The rotating brush is rotatably mounted to the slider. The slider is mounted on the rail so as to be movable in a first direction. The insertion member is inserted into the insertion hole in the first direction. As the button is moved, the first protrusion is selectively positioned in a movement path in the first direction of the second protrusion.

15 Claims, 14 Drawing Sheets

(51) Int. Cl.
*A46B 13/02* (2006.01)
*A47L 5/26* (2006.01)

(52) U.S. Cl.
CPC ..... *A47L 5/26* (2013.01); *A47L 9/0411* (2013.01); *A46B 2200/3033* (2013.01)

(58) Field of Classification Search
USPC ..... 15/383, 363, 389, 390, 391, 392
See application file for complete search history.

(56) References Cited

U.S. PATENT DOCUMENTS

| | | | | |
|---|---|---|---|---|
| 2006/0064828 | A1* | 3/2006 | Stein | A47L 9/0455 15/52.1 |
| 2014/0066278 | A1* | 3/2014 | Stein | A47L 9/0455 492/47 |
| 2015/0265117 | A1* | 9/2015 | Genn | A47L 9/0455 15/363 |
| 2016/0220083 | A1* | 8/2016 | Thorne | A47L 9/0411 |
| 2017/0055791 | A1 | 3/2017 | Lim et al. | |
| 2017/0332868 | A1* | 11/2017 | Nam | A47L 11/4066 |
| 2018/0184867 | A1* | 7/2018 | Sun | A47L 9/2884 |
| 2018/0333028 | A1 | 11/2018 | Carswell et al. | |
| 2020/0187741 | A1* | 6/2020 | Villaroman | A47L 5/225 |

FOREIGN PATENT DOCUMENTS

| | | | | |
|---|---|---|---|---|
| CN | 209826559 | U | 12/2019 | |
| EP | 3 245 927 | B1 | 1/2021 | |
| KR | 10-2018-0088219 | A | 8/2018 | |
| KR | 10-1917702 | B1 | 11/2018 | |
| WO | WO-0141618 | A1 * | 6/2001 | A47L 9/0411 |

* cited by examiner

VACUUM CLEANER

CROSS-REFERENCE TO RELATED APPLICATIONS

This application is the National Phase of PCT International Application No. PCT/KR2020/016364, filed on Nov. 19, 2020, which claims priority under 35 U.S.C. 119 (a) to Korean Patent Application No. 10-2020-0005625, filed in the Republic of Korea on Jan. 15, 2020, all of which are hereby expressly incorporated by reference into the present application.

FIELD

The present disclosure relates to a vacuum cleaner, and more particularly, to a vacuum cleaner capable of cleaning dust on a cleaning surface by using a rotating brush.

BACKGROUND

Vacuum cleaners may have different cleaning capabilities depending on the type of brush mounted therein.

When cleaning floors or papered floors with a smooth cleaning surface, a floor brush made of soft flannel is advantageous in terms of cleaning efficiency.

However, when cleaning soft cleaning surfaces such as sofas, blankets, or carpets, a carpet brush made of a stiff plastic material is advantageous in terms of cleaning efficiency.

In this regard, Korean Patent Registration No. 1917702 (hereinafter referred to as 'Related Art') discloses a cleaner. The cleaner according to the Related Art includes a main body, a rotation driver, and a cleaning module.

The main body includes a module mounting portion therein. The rotation driver is disposed on one side of the module mounting portion. The cleaning module is detachably mounted to the module mounting portion through one side of the main body of the cleaner. The cleaning module includes a holder and a cleaning member.

The holder is inserted into or taken out of the module mounting portion in an axial direction of the cleaning member. The cleaning member is rotatably supported by the holder. The cleaning member is rotated by a driving force provided from the rotation driver.

The cleaning module is detachably mounted to the module mounting portion through one side of a housing. A hook manipulating member is provided on a second side cover. The cleaning module is separated from the housing by a user manipulating the hook manipulating member. When the cleaning module is taken out of the housing, an inner cover is exposed. The second side cover and the inner cover are detachably coupled to each other.

A second member is provided with a hook-coupling member. An insertion hole is formed in the inner cover. The hook-coupling member is hook-coupled to the inner cover through the insertion hole. When the user causes the hook manipulating member to move linearly, the hook-coupling member moves linearly to release the hook-coupling.

When the cleaner is used, the cleaning member generates a frictional force with the cleaning surface while rotating. The cleaning surface may be a blanket or a carpet. The user cleans the cleaning surface while moving the main body. The main body may be turned in a left-right direction while moving. Alternatively, the main body may be turned in a forward and backward direction and an inclined direction while moving.

When the cleaner is used, a reaction force and a friction force of the cleaning surface are continuously applied to the cleaning member. When the direction of the main body is changed, the reaction force and the friction force of the cleaning surface may be applied to the cleaning member in the axial direction. Accordingly, a coupling force between the second side cover and the inner cover should be sufficiently greater than the axial force applied to the cleaning member.

The hook-coupling between the hook-coupling member and the insertion hole generates the coupling force between the second side cover and the inner cover. In mechanical devices, there is necessarily a gap between components. The hook-coupling member is movably mounted on the second side cover. There is the gap between the second side cover and the hook-coupling member. There is also the gap between the hook-coupling member and the inner cover. That is, there are a plurality of gaps between the second side cover and the inner cover.

Accordingly, the cleaner disclosed in the Related Art has a disadvantage in that the second side cover is shaken in the axial direction by the axial force applied to the cleaning member. The shaking of the second side cover causes noise and wear due to collision between the second side cover and the housing. There is a need for a method to reduce the above-mentioned noise and wear while the cleaner is in use.

In the cleaner disclosed in the Related Art, in order to couple the cleaning module to the main body, the user should ⓐ cause the hook manipulating member to move linearly, and ⓑ subsequently, push the cleaning module in the axial direction of the cleaning member. Then, the user should ⓒ insert the hook-coupling member into the insertion hole by causing the hook manipulating member to move linearly.

That is, in the cleaner disclosed in the Related Art, in order to couple the cleaning module to the main body, the user should proceed with three steps of ⓐ, ⓑ, and ⓒ. However, elderly people or children may have difficulty in proceeding with the three steps of ⓐ, ⓑ, and ⓒ.

When a spring is mounted to the hook-coupling member, the hook-coupling member may be inserted into the insertion hole only by pushing the cleaning module in the axial direction of the cleaning member. An inclined surface is formed at the hook-coupling member. When the cleaning module is moved in the axial direction of the cleaning member, the hook-coupling member slides into the insertion hole through the inclined surface.

In order for the hook-coupling member to slide into the insertion hole through the inclined surface, the inclined surface should be inclined at a small angle of approximately 45 degrees or less to the axial direction of the cleaning member. However, when the inclined surface is inclined at such a small angle to the axial direction of the cleaning member, there is a disadvantage in that the contact area between the hook-coupling member and the inner cover is small.

In addition, in order to separate the cleaning module from the main body, the user should ① cause the hook manipulating member to move linearly and ② pull the cleaning module in the axial direction of the cleaning member. However, when the spring is mounted to the hook-coupling member, the user should proceed with two steps of ① and ② at the same time. Accordingly, elderly people or children may have difficulty in proceeding with the two steps of ① and ② at the same time.

SUMMARY

The present disclosure is directed to providing a vacuum cleaner configured to prevent noise and wear due to collision between a detachable cover and a housing, which is caused by an axial force applied to a rotating brush.

The present disclosure is further directed to providing a vacuum cleaner configured such that a housing and a brush module can be easily coupled to or separated from each other.

The present disclosure is still further directed to a vacuum cleaner configured such that a housing and a brush module can be firmly coupled to each other in an axial direction of a rotating brush.

In a vacuum cleaner according to embodiments of the present disclosure, an insertion member may be inserted into an insertion hole in a first direction, and as a button is moved, a first protrusion may be selectively positioned in a movement path in the first direction of a second protrusion.

Coupling and separation between a housing and a detachable cover may be made by the movement of the button. A rotating brush may be rotatably mounted to the detachable cover. Accordingly, the housing and the rotating brush can be easily coupled to or separated from each other.

A vacuum cleaner according to the embodiments of the present disclosure may include a main body and a suction nozzle.

The main body may be configured to generate an air pressure difference. An inside of the main body may be provided with a blower.

The suction nozzle may be configured to suck up dust on a cleaning surface through the generated air pressure difference.

The suction nozzle may include the housing, the button, the rotating brush, and the detachable cover.

The housing may include a passage through which the dust moves to the main body. The passage may be formed at the rear of the housing. The passage may be formed in a cylindrical shape.

When the blower generates the air pressure difference, the dust and foreign substances on the cleaning surface may move to the main body through the passage in the suction nozzle.

The housing may include the insertion hole.

The button may be mounted on the housing to be movable in a third direction. The first direction may be a direction perpendicular to a direction of a rotation axis of the rotating brush. The third direction may be a direction perpendicular to both the first direction and the direction of the rotation axis of the rotating brush.

The button may include the first protrusion. The first protrusion may protrude in the direction of the rotation axis of the rotating brush. The first protrusion may form a first surface inclined with respect to the first direction.

The rotating brush may be configured to rotate so as to push the dust on the cleaning surface toward the passage. The rotating brush may include a body, a brush, a second shaft, and a third shaft.

The body may be formed in a hollow cylindrical shape. A central axis of the body may serve as the rotation axis of the rotating brush.

The brush may be attached to an outer surface of the body. When the body rotates, the brush may scratch the cleaning surface.

The second shaft may be coupled to one side of the rotation axis of the body. The second shaft may be configured to rotate in engagement with a first shaft. The first shaft may be configured to transmit a rotating force of a motor to the rotating brush.

The third shaft may be coupled to the other side of the rotation axis of the body. The third shaft may couple the body to the slider in such a way that the body may rotate.

The third shaft may include a coupling member, a rotating member, a first extending portion, and a second extending portion.

The coupling member may generate a coupling force with the body. The rotating member in a cylindrical shape may be coupled to the inside of the coupling member.

A bearing may be mounted to the slider. The rotating member may be rotatably mounted to the slider by means of the bearing.

The first extending portion may extend in the radial direction of the rotating member around the rotating member. One side of the first extending portion may be spaced apart from one side of a guiding member by a predetermined distance in the axial direction.

One side of the first extending portion may be formed in a ring shape around the rotation axis of the body. One side of the guiding member may be formed in a ring shape around the rotation axis of the body.

The second extending portion may extend from the first extending portion in the axial direction. The second extending portion may be formed in a cylindrical shape around the shaft. A projection may be formed on an outer surface of the second extending portion. The projection may be spaced apart from an inner surface of the guiding member by a predetermined distance.

The projection may be disposed inside the guiding member. The projection may be formed along the circumferential direction of the body around the rotation axis of the body. The inner surface of the guiding member may be formed in a cylindrical shape around the rotation axis of the body.

When an external force is applied to the body in a direction inclined with respect to the axial direction, the projection and the inner surface of the guiding member may come into contact with each other.

The insertion member and the second protrusion may be formed on the detachable cover.

The inner surface of the insertion hole may form movement and rotation boundaries that prevent movement and rotation of the insertion member except for movement in the movement path in the first direction.

A latching groove may be formed in the housing. A third protrusion may be formed on the detachable cover. When the insertion member is inserted into the insertion hole in the first direction, the third protrusion may be inserted into the latching groove in the first direction.

The latching groove may be formed on the opposite side of the insertion hole based on the rotation axis. The inner surface of the latching groove may form a movement boundary that prevents movement of the third protrusion in the first direction and the direction of the rotation axis.

Accordingly, the housing and the detachable cover may form a firm coupling force between each other in the axial direction of the rotating brush. In addition, it is possible to prevent noise and wear due to collision between the detachable cover and the housing, which is caused by an axial force applied to the rotating brush.

The second protrusion may protrude from the detachable cover in the axial direction. The second protrusion may form a second surface inclined with respect to the first direction.

The second protrusion may move in the first direction to form an inclined contact surface with the first protrusion. The first surface and the second surface may form the inclined contact surface. The second protrusion may push the first protrusion outside the movement path in the first direction of the second protrusion through the inclined contact surface.

The housing may be provided with an elastic member. The elastic member may generate a resilience for pushing the first protrusion in the movement path in the first direction. The elastic member may be formed as a compression spring.

The detachable cover may include a cover body and the slider.

The cover body may cover one side of the housing. The insertion member, the second protrusion, and a rail may be formed on the cover body.

The rotating brush may be rotatably mounted to the slider. The slider may be mounted on the rail so as to be movable in the first direction.

The rail may be provided with an elastic member. The elastic member may generate a resilience for pushing the slider in the first direction. The elastic member may be formed as a compression spring.

When the first protrusion deviates from the movement path in the first direction of the second protrusion, the insertion member may be separated from the insertion hole in a direction opposite to the first direction by the force of the elastic member.

A driver configured to rotate the first shaft may be installed in the housing. The driver may include a motor. The rotating force of the motor may be transmitted to the first shaft through a belt transmission.

The rotating brush may be configured to rotate in engagement with the first shaft.

An entrance through which the rotating brush passes toward the first shaft may be formed in the housing. When the second shaft is fitted into the first shaft, the slider may be inserted into the entrance.

An insertion groove may be formed in the entrance. The protrusion may be formed on the guiding member. As the second shaft is fitted into the first shaft, the protrusion may be inserted into the insertion groove.

An inner surface of the insertion groove may constrain rotation of the slider about the rotation axis. Even when the cover body moves in the first direction, the rotating brush may continue to be in engagement with the first shaft.

According to the embodiments of the present disclosure, since the housing and the detachable cover are coupled to each other at a plurality of points by inserting the insertion members formed in the detachable cover into the insertion holes formed in the housing, loosening between the detachable cover and the housing due to the axial force applied to the rotating brush can be minimized.

According to the embodiments of the present disclosure, since the axial force applied to the rotating brush is distributed to contact surfaces between the insertion members and the insertion holes, the detachable cover and the housing can be firmly coupled to each other in the axial direction of the rotating brush.

According to the embodiments of the present disclosure, since the rail is provided with the elastic member for pushing the slider in the first direction, and when the first protrusion deviates from the movement path in the first direction of the second protrusion, the insertion member is separated from the insertion hole in the direction opposite to the first direction by the force of the elastic member, the housing and the brush module can be easily separated from each other by simply pressing the button.

According to the embodiments of the present disclosure, since when the cover body is moved in the first direction while the rotating brush is in engagement with the first shaft, the first protrusion is positioned in the movement path in the first direction of the second protrusion by the insertion member being inserted into the insertion hole, the housing and the brush module can be easily coupled to each other.

DESCRIPTION OF SYMBOLS

1: VACUUM CLEANER
10: SUCTION NOZZLE
100: HOUSING
110: MAIN BODY HOUSING
110A: ENTRANCE
110B: INSERTION GROOVE
111: SUCTION SPACE
112: LATCHING PORTION
113: INSERTION HOLE
114: LATCHING GROOVE
115: ELASTIC MEMBER
120: CONNECTOR
121: PASSAGE
122: RELEASE BUTTON
130: BUTTON
131: FIRST PROTRUSION
131F: FIRST SURFACE
W: WHEEL
200: BUSH MODULE
210: ROTATING BRUSH
211: BODY
212: BRUSH
213: SECOND SHAFT
213P: PROJECTION
214: THIRD SHAFT

214A: COUPLING MEMBER
214A1: ROTATING MEMBER
214B: FIRST EXTENDING PORTION
214C: SECOND EXTENDING PORTION
220: DETACHABLE COVER
221: COVER BODY
221A: INSERTION MEMBER
221A1: SUPPORTING MEMBER
221A2: LEADING-IN MEMBER
221F: SECOND SURFACE
221B: SECOND PROTRUSION
221C: THIRD PROTRUSION
221D: RAIL
221D1: FIRST SUPPORTING MEMBER
221D2: FIRST PROJECTION
221D3: MOUNTING PORTION
221E: ELASTIC MEMBER
222: SLIDER
222A: BASE
222A1: LIMITING MEMBER
222B: MOUNTING PORTION
222B1: SECOND SUPPORTING MEMBER
222B2: SECOND PROJECTION
222C: HUB
222C1: BEARING
222D: GUIDING MEMBER
222E: EXTENDING PORTION
222P: PROTRUSION
20: MAIN BODY
21: HANDLE
D1: FIRST DIRECTION
D3: THIRD DIRECTION

DETAILED DESCRIPTION

Hereinafter, the embodiments disclosed in this specification will be described in detail with reference to the accompanying drawings. The detailed description of related known technology will be omitted when it may obscure the subject matter of the embodiments according to the present disclosure.

Figure 1:
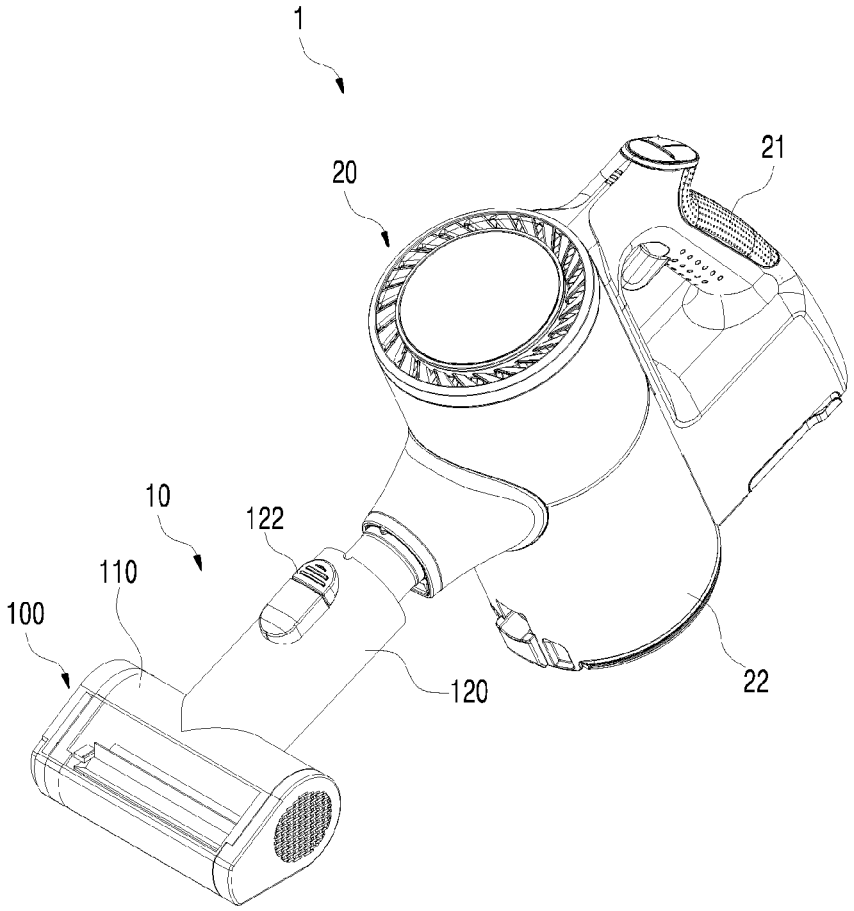
FIG. 1 is a perspective view of a vacuum cleaner, according to an embodiment of the present disclosure.

FIG. 1 is a perspective view of a vacuum cleaner 1, according to an embodiment of the present disclosure.

As illustrated in FIG. 1, the vacuum cleaner 1 according to an embodiment of the present disclosure includes a main body 20 and the suction nozzle 10.

The suction nozzle 10 is coupled to the main body 20. The suction nozzle 10 may be coupled to the main body 20 through an extension pipe. A user may move the suction nozzle 10 forward and backward on a cleaning surface while gripping a handle 21 formed on the main body 20. The cleaning surface may refer to soft surfaces such as sofas, blankets, or carpets.

The main body 20 is configured to generate an air pressure difference. A blower is provided inside the main body 20. When the blower generates the air pressure difference, foreign substances, such as hairs, animal hairs, and dust on the cleaning surface is moved to the main body 20 through a passage 121 of the suction nozzle 10.

A centrifugal dust collector may be provided inside the main body 20. The foreign substances may be received in a dust container 22.

Figure 2:
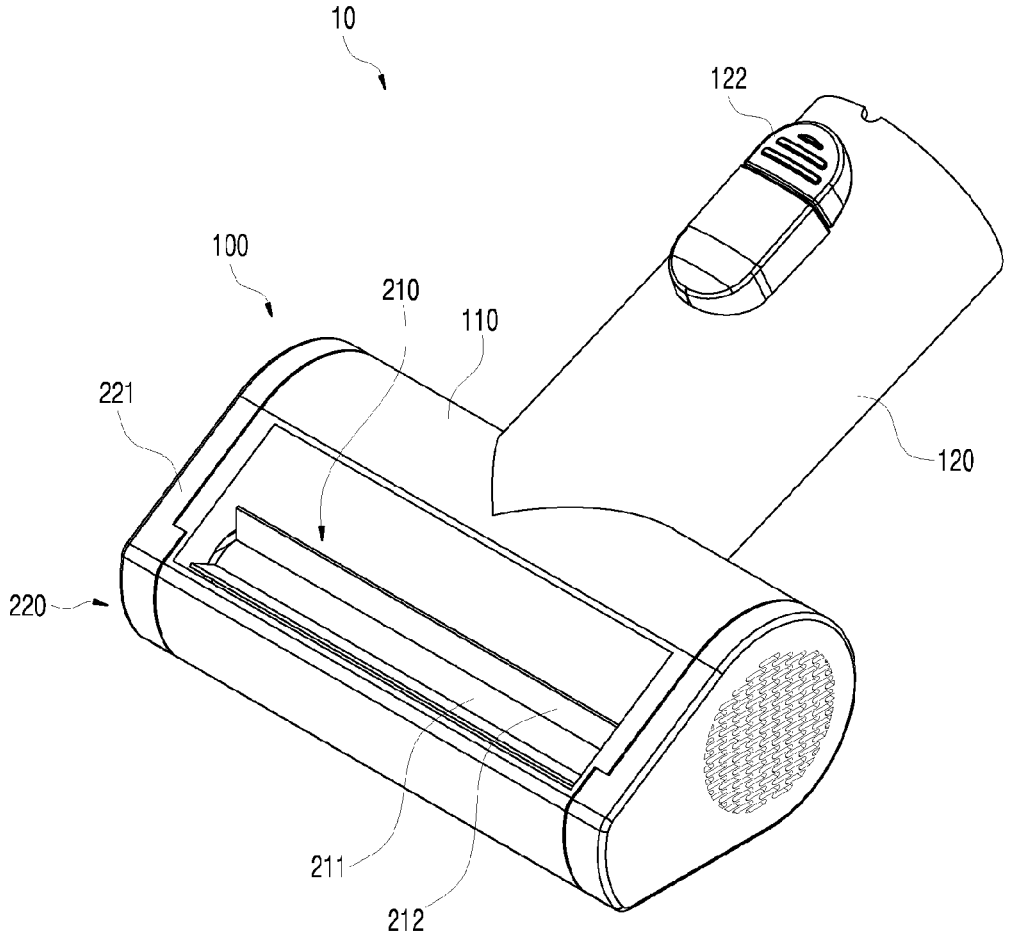
FIG. 2 is a top perspective view of a suction nozzle of the vacuum cleaner illustrated in FIG. 1.
Figure 3:
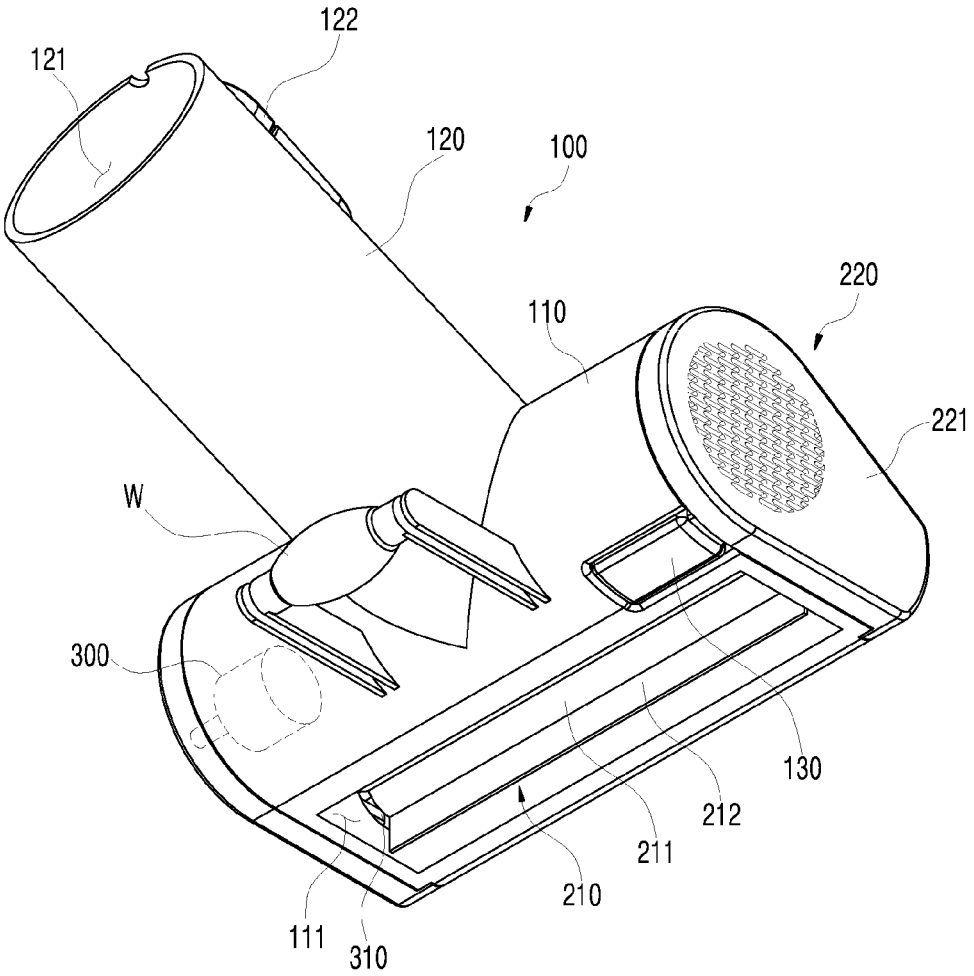
FIG. 3 is a bottom perspective view of a suction nozzle of the vacuum cleaner illustrated in FIG. 1.

FIG. 2 is a top perspective view of the suction nozzle 10 of the vacuum cleaner 1 illustrated in FIG. 1. FIG. 3 is a bottom perspective view of the suction nozzle 10 of the vacuum cleaner 1 illustrated in FIG. 1.

The suction nozzle 10 is configured to suck up the foreign substances, such as hairs, animal hairs, and dust on the cleaning surface through the generated air pressure difference. As illustrated in FIGS. 2 and 3, the suction nozzle 10 includes a housing 100, a brush module 200, and a driver 300.

Hereinafter, in order to facilitate understanding of the present disclosure, a side of the suction nozzle 10 where a rotating brush 210 is positioned will be referred to as the front of the suction nozzle 10, and a side of the suction nozzle 10 where a connector 120 is positioned will be referred to as the rear of the suction nozzle 10.

As illustrated in FIGS. 2 and 3, the housing 100 includes a main body housing 110 and the connector 120.

As illustrated in FIG. 2, the main body housing 110 covers the cleaning surface. A transparent window may be provided on the top of the main body housing 110. The user may check rotation of the rotating brush 210 through the transparent window. The user may also check the foreign substances attached to the rotating brush 210 through the transparent window.

As illustrated in FIG. 3, the main body housing 110 includes a suction space 111. The suction space 111 is opened downward. When the blower generates the air pressure difference, the foreign substances, such as hairs, animal hairs, and dust on the cleaning surface enter the suction space 111 and then move to the main body 20 through the passage 121.

The rotating brush 210 is mounted at the front of the main body housing 110. The front portion of the main body housing 110 is formed to surround an upper portion of the rotating brush 210. The main body housing 110 is spaced apart from the upper portion of the rotating brush 210 by a predetermined distance.

The rotating brush 210 is configured to push the foreign substances, such as hairs, animal hairs, and dust on the cleaning surface toward the rear of the rotating brush 210 while rotating. The foreign substances pushed toward the rear of the rotating brush 210 may easily enter the passage 121.

Wheels W are mounted to a lower portion of the main body housing 110. The wheels W may roll on the cleaning surface. A user may move the suction nozzle 10 forward and backward on the cleaning surface while gripping a handle 21 formed on the main body 20.

The connector 120 forms the passage 121 through which the foreign substances in the suction space 111 move to the main body 20. The connector 120 is substantially formed in a pipe shape.

The connector 120 is detachably coupled to the main body 20. A release button 122 is mounted on an upper portion of the connector 120. When the release button 122 is pressed, the suction nozzle 10 and the main body 20 may be separated from each other.

As illustrated in FIG. 3, the driver 300 is mounted to the main body housing 110. The driver 300 is configured to rotate a first shaft 310. The first shaft 310 may be rotatably mounted to the main body housing 110. Alternatively, the first shaft 310 may be rotatably mounted to a separate bracket.

The driver 300 includes a motor. The rotating force of the motor may be transmitted to the first shaft 310 through a belt transmission.

Figure 4:
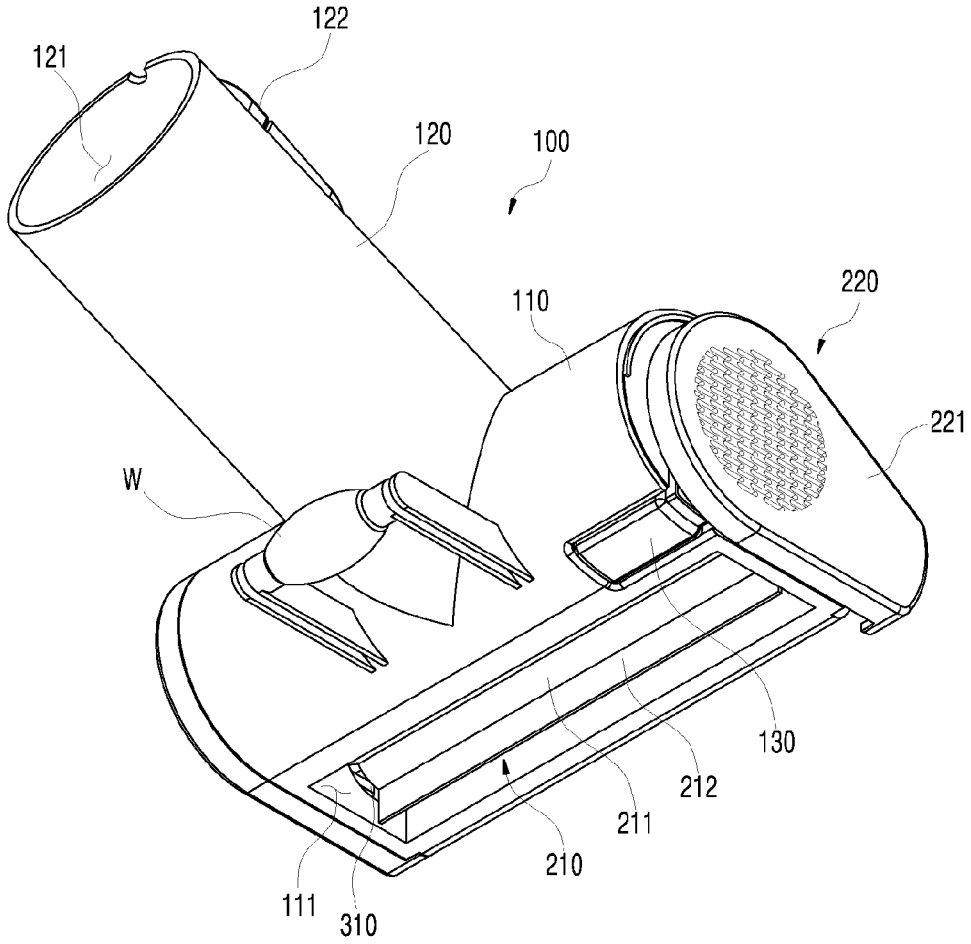
FIG. 4 is a bottom perspective view illustrating a state in which a coupling between a housing and a brush module of the suction nozzle illustrated in FIG. 3 is released.
Figure 5:
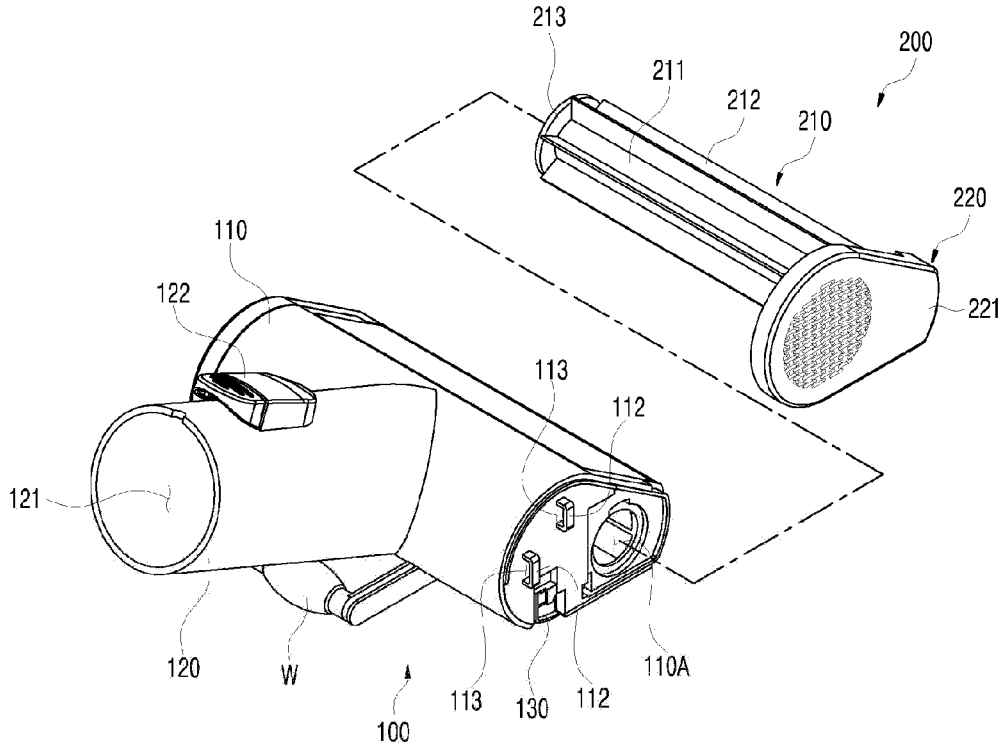
FIG. 5 is an exploded perspective view illustrating a state in which the housing and the bush module of the suction nozzle illustrated in FIG. 4 are separated from each other.
Figure 6:
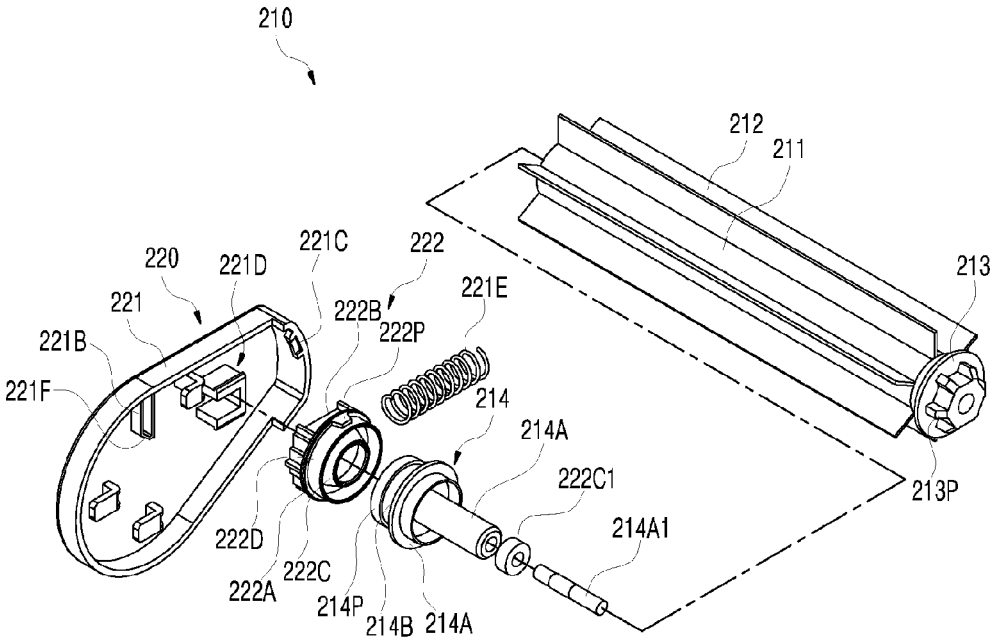
FIG. 6 is an exploded perspective view of the brush module illustrated in FIG. 5.

FIG. 4 is a bottom perspective view illustrating a state in which a coupling between the housing 100 and the brush module 200 of the suction nozzle 10 illustrated in FIG. 3 is released. FIG. 5 is an exploded perspective view illustrating a state in which the housing 100 and the bush module 200 of the suction nozzle 10 illustrated in FIG. 4 are separated from each other. FIG. 6 is an exploded perspective view of the brush module 200 illustrated in FIG. 5.

As illustrated in FIGS. 4 and 5, the brush module 200 includes the rotating brush 210 and a detachable cover 220.

As illustrated in FIG. 6, the rotating brush 210 is configured to push the dust and the foreign substances on the cleaning surface toward the rear of the rotating brush 210. The rotating brush 210 includes a body 211, a brush 212, a second shaft 213, and a third shaft 214.

The body 211 forms a skeleton of the rotating brush 210. The body 211 is formed in a hollow cylindrical shape. The body 211 forms a uniform rotational inertia along the circumferential direction of the body 211. The body 211 may be made of synthetic resin or metal.

The central axis of the body 211 serves as the rotation axis of the rotating brush 210. The rotation axis of the body 211 is positioned in the same line as the rotation axes of the first shaft 310, the second shaft 213, and the third shaft 214. Hereinafter, in order to facilitate understanding of the present disclosure, the direction of the rotation axis of the rotating brush 210 will be referred to as an "axial direction".

The brush 212 is attached to an outer surface of the body 211. When the body 211 rotates, the brush 212 scratches the cleaning surface. During this process, the foreign substances, such as hairs, animal hairs, and dust attached to the cleaning surface are detached from the cleaning surface, and are then pushed toward the rear of the brush 212.

The brush 212 may be made of a stiff plastic material. When cleaning soft cleaning surfaces such as sofas, blankets, or carpets, the carpet brush 212 made of the stiff plastic material is advantageous in terms of cleaning efficiency.

As illustrated in FIG. 5, an entrance 110A is formed on one side of the main body housing 110. The rotating brush 210 moves to the first shaft 310 through the entrance 110A. The rotating brush 210 is in engagement with the first shaft 310. The first shaft 310 is configured to transmit a rotating force of the motor to the rotating brush 210. The second shaft 213 is configured to rotate in engagement with the first shaft 310.

The second shaft 213 is coupled to one side of the rotation axis of the body 211. A plurality of projections 213P are formed on the second shaft 213. The projections 213P may be formed along the circumferential direction of the second shaft 213 around the rotation axis of the second shaft 213.

Figure 7:
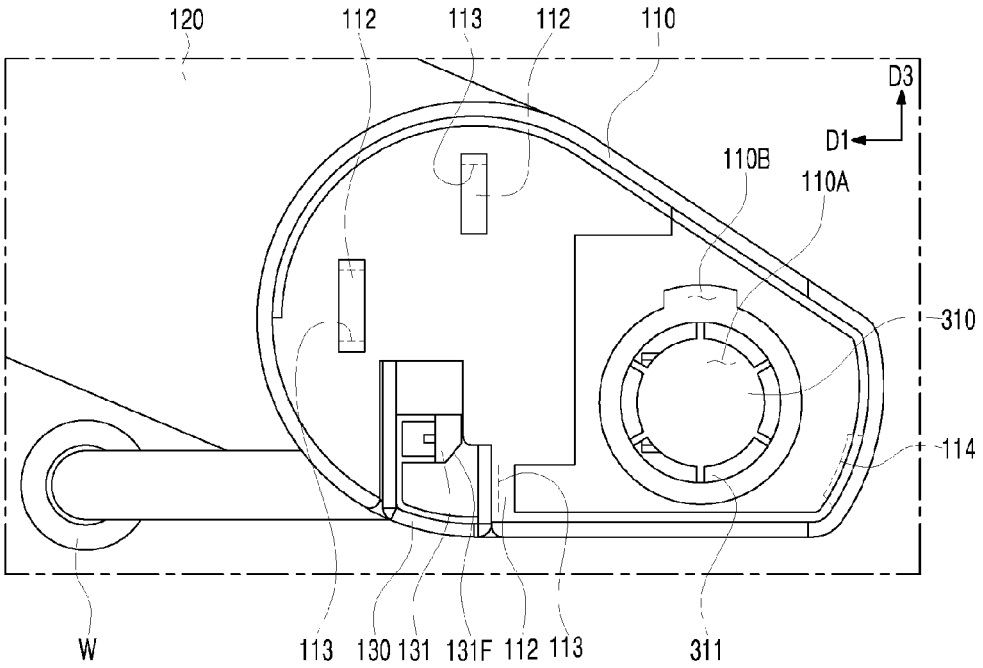
FIG. 7 is a side view of the housing illustrated in FIG. 5.

FIG. 7 is a side view of the housing 100 illustrated in FIG. 5.

As illustrated in FIG. 7, a plurality of grooves 311 are formed in the first shaft 310. The grooves 311 may be formed along the circumferential direction of the first shaft 310 around the rotation axis of the first shaft 310. The rotating force of the first shaft 310 is transmitted to the rotating brush 210 through the second shaft 213 by inserting the projections 213P into the grooves 311.

An insertion groove 110B is formed in the entrance 110A. A protrusion 222P is formed on a guiding member 222D. As the second shaft 213 of the rotating brush 210 is fitted into the first shaft 310, the protrusion 222P is inserted into the insertion groove 110B. An inner surface of the insertion groove 110B constrains rotation of a slider 222 about the rotation axis.

Figure 8:
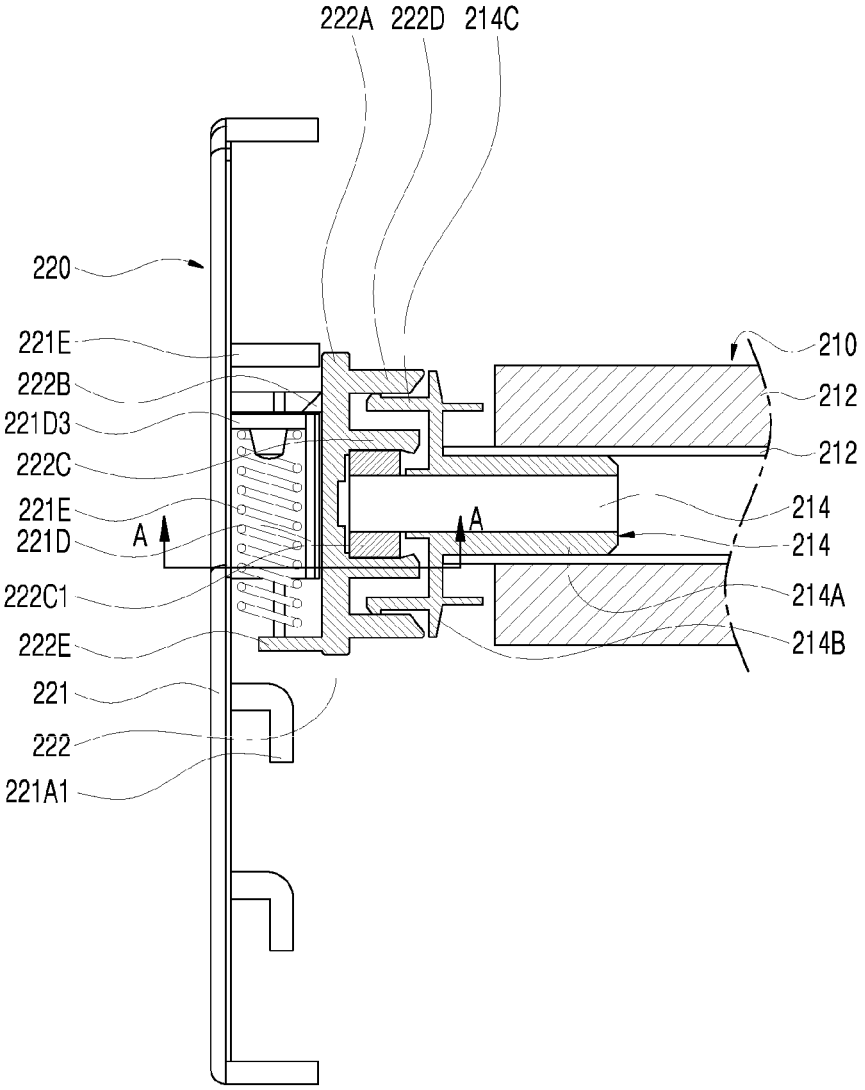
FIG. 8 is a cross-sectional view of the brush module illustrated in FIG. 5.

FIG. 8 is a cross-sectional view of the brush module illustrated in FIG. 5.

As illustrated in FIGS. 6 and 8, the third shaft 214 couples the body 211 to the slider 222 in such a way that the body 211 may rotate. The third shaft 214 is coupled to the other side of the rotating axis of the body 211. The third shaft 214 includes a coupling member 214A, a rotating member 214A1, a first extending portion 214B, and a second extending portion 214C.

As illustrated in FIG. 8, the coupling member 214A is inserted into the inside of the body 211. The coupling member 214A generates a coupling force with the body 211. The rotating member 214A1 having a cylindrical shape is coupled to the inside of the coupling member 214A.

A bearing 222C1 is mounted to a hub 222C of the slider 222. The rotating member 214A1 is rotatably mounted to the slider 222 by means of the bearing 222C1. Accordingly, the rotating brush 210 is rotatably mounted to the slider 222.

The first extending portion 214B extends in the radial direction of the rotating member 214A1 around the rotating member 214A1. The first extending portion 214B is formed in a circular plate shape. One side of the first extending portion 214B is spaced apart from one side of the guiding member 222D by a predetermined distance in the axial direction.

One side of the first extending portion 214B is formed in a ring shape around the rotation axis of the body 211. One side of the guiding member 222D is formed in a ring shape around the rotation axis of the body 211.

When an external force is applied to the body 211 in a direction inclined with respect to the axial direction, one side of the first extending portion 214B and one side of the guiding member 222D come into contact with each other. Accordingly, loosening of the body 211 by the external force applied to the body 211 in the direction inclined with respect to the axial direction is suppressed.

As illustrated in FIG. 8, the second extending portion 214C extends from the first extending portion 214B in the axial direction. The second extending portion 214C is formed in a cylindrical shape around the shaft. A projection 214P is formed on an outer surface of the second extending portion 214C. The projection 214P is spaced apart from an inner surface of the guiding member 222D by a predetermined distance.

The projection 214P is disposed inside the guiding member 222D. The projection 214P is formed along the circumferential direction of the body 211 around the rotation axis of the body 211. The inner surface of the guiding member 222D is formed in a cylindrical shape around the rotation axis of the body 211.

When the external force is applied to the body 211 in the direction inclined with respect to the axial direction, the projection 214P and the inner surface of the guiding member 222D may come into contact with each other. Accordingly, loosening of the body 211 by the external force applied to the body 211 in the direction inclined with respect to the axial direction is suppressed.

As illustrated in FIGS. 5 and 7, a plurality of latching portions 112 and latching grooves 114 are formed on the coupling surface of the main body housing 110.

Each of the latching portions 112 includes an insertion hole 113. A plurality of insertion members 221A are formed on the detachable cover 220. The insertion members 221A are inserted into the insertion holes 113 in a first direction D1. The first direction D1 refers to the direction in which the insertion member 221A is inserted into the insertion hole 113.

The latching groove 114 is formed on the opposite side of the insertion hole 113 based on the rotation axis. A third protrusion 221C is formed on the detachable cover 220. The third protrusion 221C is inserted into the latching groove 114 in the first direction D1. When the insertion members 221A are inserted into the insertion holes 113 in the first direction D1, the third protrusion 221C is inserted into the latching groove 114.

Figure 9:
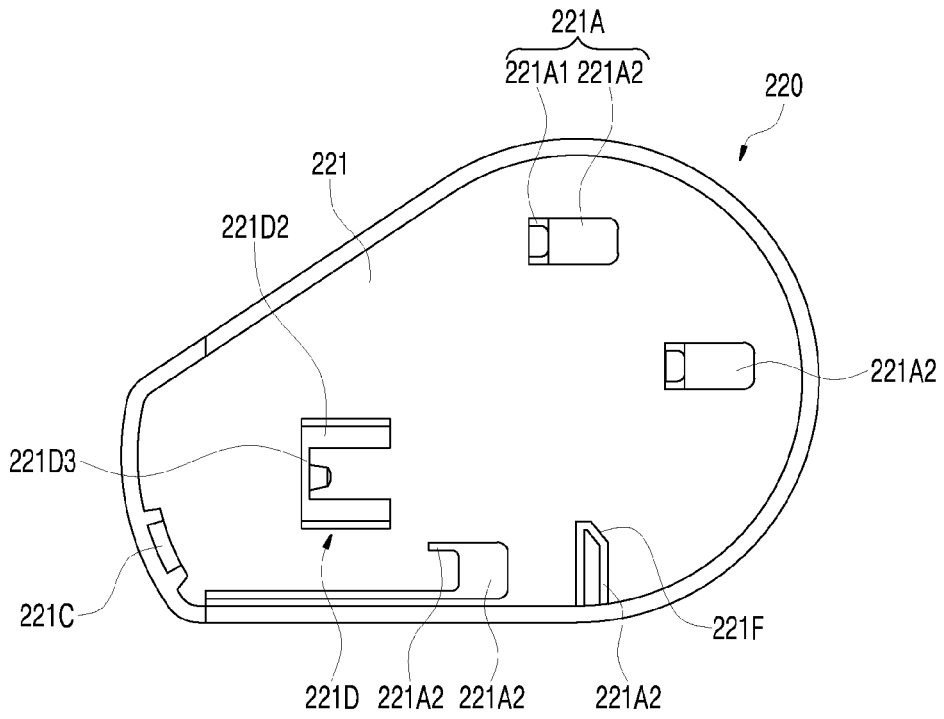
FIG. 9 is a side view of a detachable cover illustrated in FIG. 6.

FIG. 9 is a side view of the detachable cover 220 illustrated in FIG. 6.

As illustrated in FIGS. 8 and 9, the detachable cover 220 includes the cover body 221 and the slider 222.

In the coupled state, the cover body 221 covers the coupling surface of the housing 100. A boundary of the cover body 221 forms an outline similar to a profile of the coupling surface.

The boundary of the cover body 221 protrudes toward an edge of the coupling surface. In the coupled state, the boundary of the cover body 221 is in close contact with the edge of the coupling surface of the main body housing 110. A hole through which air enters and exits is formed in the cover body 221.

As illustrated in FIGS. 8 and 9, a plurality of insertion members 221A, a second protrusion 221B, a third protrusion 221C, and a rail 221D are formed on the cover body 221.

Each of the insertion members 221A includes a supporting member 221A1 and a leading-in member 221A2.

The supporting members 221A1 protrude from the cover body 221 in the axial direction. The leading-in members 221A2 extend from the supporting members 221A1 in the first direction D1. The leading-in members 221A2 are inserted into the insertion holes 113 in the first direction D1.

The first direction D1 refers to the direction in which the leading-in member 221A2 is inserted into the insertion hole 113. Hereinafter, in order to facilitate understanding of the present disclosure, the direction opposite to the first direction D1 will be referred to as a second direction.

The user may insert the leading-in members 221A2 into the insertion holes 113 by moving the detachable cover 220 in the first direction D1. The first direction D1 may be perpendicular to the direction of the rotation axis of the body 211. The inner surface of the insertion hole 113 forms movement and rotation boundaries that prevent movement and rotation of the leading-in member 221A2 except for movement in the movement path in the first direction D1.

The third protrusion 221C protrudes from the cover body 221 in the first direction D1. The third protrusion 221C is inserted into the latching groove 114 in the first direction D1. When the leading-in members 221A2 are inserted into the insertion holes 113 in the first direction D1, the third protrusion 221C is inserted into the latching groove 114.

The latching groove 114 is formed on the opposite side of the insertion hole 113 based on the rotation axis. The inner surface of the latching groove 114 forms a movement boundary that prevents movement of the third protrusion 221C in the first direction D1 and the direction of the rotation axis.

Accordingly, movement and rotation of the insertion member 221A, except for movement in the movement path in the first direction D1, is prevented on one side based on the rotation axis. In addition, movement of the third protrusion 221C in the first direction D1 and the direction of the rotation axis is prevented on the other side based on the rotation axis.

The insertion member 221A and the third protrusion 221C are formed on the detachable cover 220. Accordingly, when the insertion members 221A are inserted into the insertion holes 113, movement of the detachable cover 220 in the axial direction is prevented on both sides based on the rotation axis.

Rotation of the detachable cover 220 is also prevented on one side based on the rotation axis. The rotation of the detachable cover 220 is prevented by means of the plurality of insertion members 221A and insertion holes 113. As a result, movement and rotation of the detachable cover 220 in the axial direction can be reliably prevented.

Movement of the detachable cover 220 in the first direction D1 is prevented on the other side based on the rotation axis. Accordingly, when the insertion members 221A are inserted into the insertion holes 113, the detachable cover 220 may move only in the second direction.

The second protrusion 221B protrudes from the cover body 221 in the axial direction. The second protrusion 221B forms a second surface 221F inclined with respect to the first direction D1.

Figure 10:
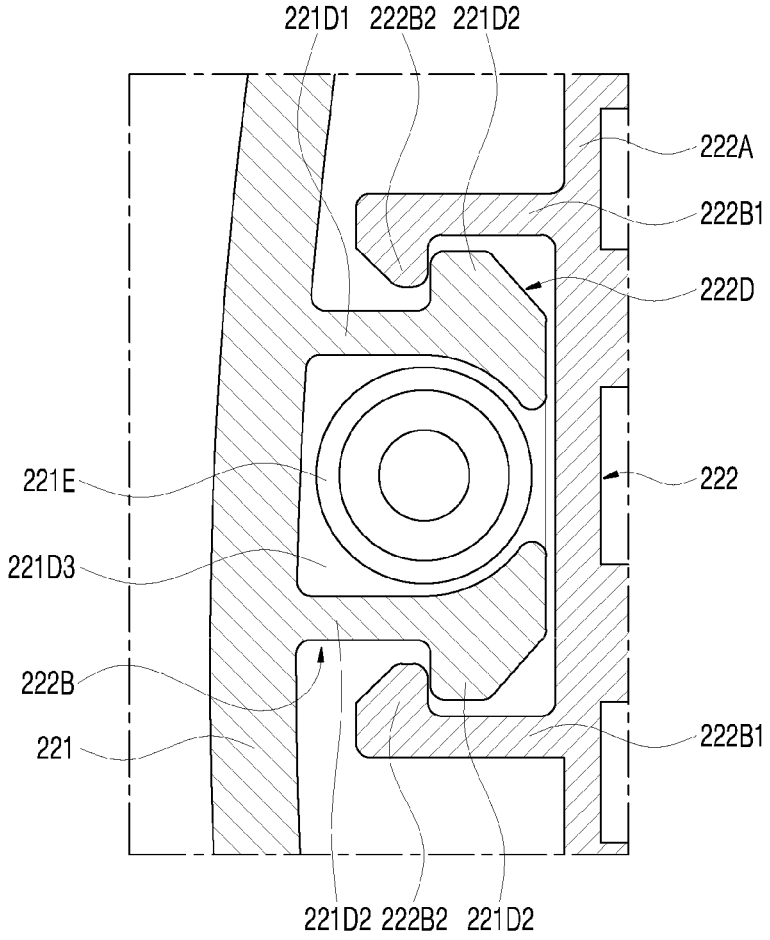
FIG. 10 is a cross-sectional view taken along line A-A of FIG. 8.

FIG. 10 is a cross-sectional view taken along line A-A of FIG. 8

As illustrated in FIGS. 8 and 10, the rail 221D includes a pair of first supporting members 221D1 and a pair of first projections 221D2.

The first supporting members 221D1 protrude from the cover body 221 in the axial direction. The first supporting members 221D1 extend in the first direction D1. The first projections 221D2 protrude from the first supporting members 221D1 in directions facing away from each other.

The slider 222 includes a base 222A, a mounting portion 222B, a hub 222C, and a guiding member 222D.

The base 222A is formed in a circular plate shape. The mounting portion 222B is formed on one surface of the base 222A. The mounting portion 222B includes a pair of second supporting members 222B1 and a pair of second projections 222B2.

The second supporting members 222B1 protrude from the base 222A in the axial direction. The second supporting members 222B1 extend in the first direction D1. The first projections 222B2 protrude from the second supporting members 222B1 in directions facing each other.

The first projections 221D2 are interposed between the base 222A and the second protrusions 221B. Accordingly, the slider 222 is mounted on the rail 221D so as to be movable in the first direction D1. In addition, loosening between the rail 221D and the slider 222 in the axial direction is prevented.

As illustrated in FIG. 8, the bearing 222C1 is mounted to the hub 222C of the slider 222. The shaft is rotatably mounted to the slider 222 by means of the bearing 222C1. Accordingly, the rotating brush 210 is rotatably mounted to the slider 222.

The guiding member 222D is formed along the circumferential direction of the body 211 around the rotation axis of the body 211. The inner surface of the guiding member 222D is formed in a cylindrical shape around the rotation axis of the body 211.

One side of the first extending portion 214B is spaced apart from one side of the guiding member 222D by a predetermined distance in the axial direction. A projection is formed on an outer surface of the second extending portion 214C. The projection is spaced apart from an inner surface of the guiding member 222D by a predetermined distance.

When an external force is applied to the body 211 in a direction inclined with respect to the axial direction, one side of the first extending portion 214B and one side of the guiding member 222D come into contact with each other. Accordingly, loosening of the body 211 by the external force applied to the body 211 in the direction inclined with respect to the axial direction is suppressed.

When an external force is applied to the body 211 in a direction inclined with respect to the axial direction, the projection and the inner surface of the guiding member 222D may come into contact with each other. Accordingly, loosening of the body 211 by the external force applied to the body 211 in the direction inclined with respect to the axial direction is suppressed.

As illustrated in FIGS. 8 and 10, the rail 221D is provided with an elastic member 221E. The elastic member 221E generates a resilience for pushing the slider 222 in the first direction D1. The elastic member 221E may be formed as a compression spring.

The rail 221D is provided with a mounting portion 221D3. The elastic member 221E is mounted to the mounting portion 221D3. An extending portion 222E to which the resilience of the elastic member 221E is applied is formed on one surface of the slider 222.

A limiting member 222A1 is formed on one surface of the base 222A. The limiting member 222A1 is in contact with the rail 221D by the resilience of the elastic member 221E in a state in which a coupling between the housing 100 and the brush module 200 is released. The limiting member 222A1 limits the extent to which the slider 222 is pushed by the resilience of the elastic member 221E.

Figure 11:
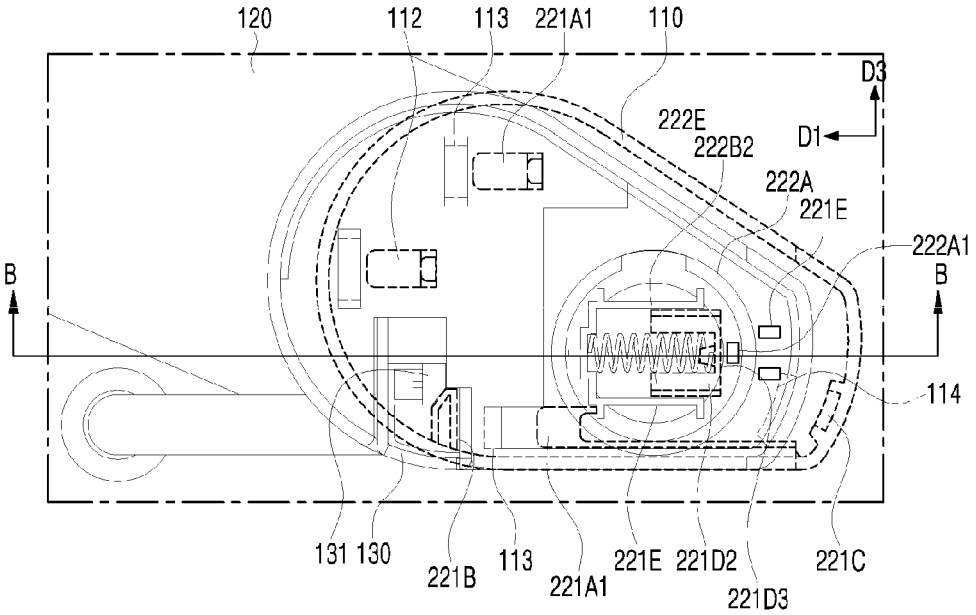
FIG. 11 is a partial perspective view illustrating a state in which a coupling between the housing and the brush module illustrated in FIG. 4 is released.
Figure 12:
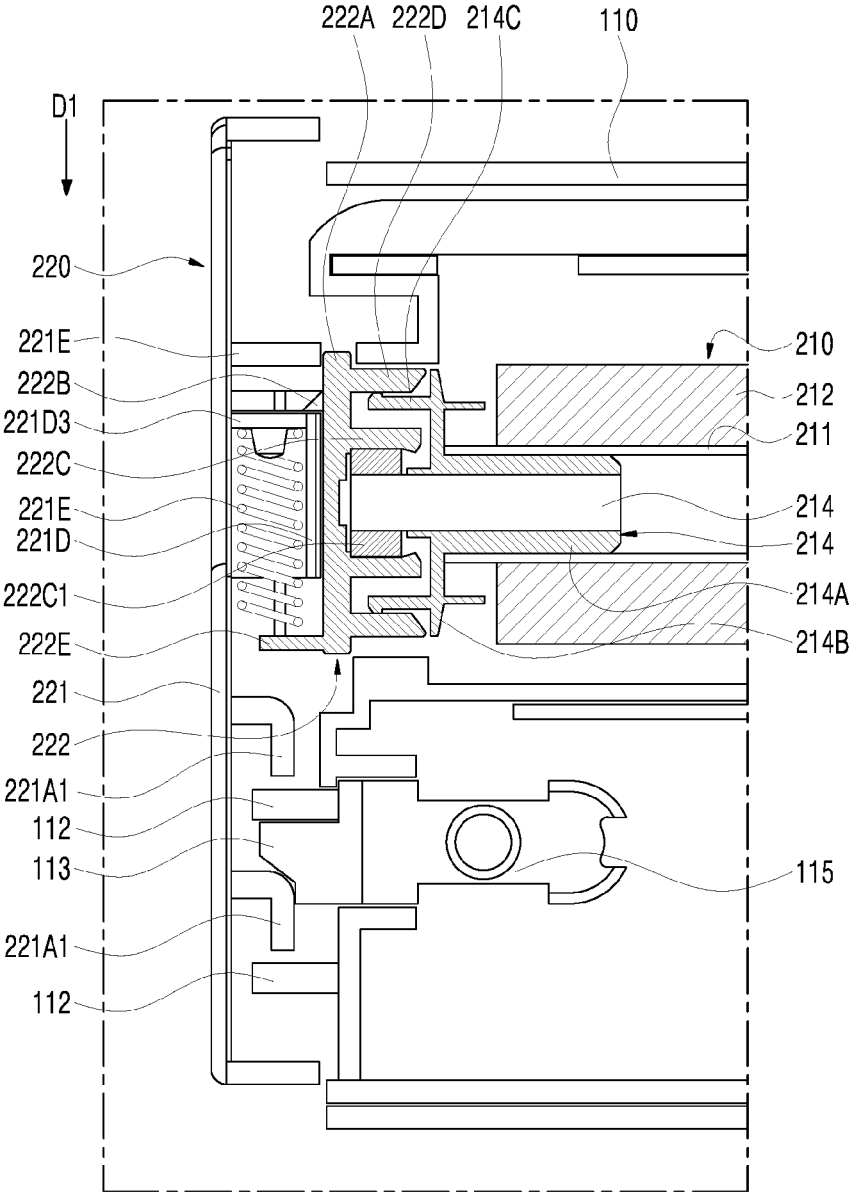
FIG. 12 is a cross-sectional view taken along line B-B of FIG. 11.

FIG. 11 is a partial perspective view illustrating a state in which a coupling between the housing 100 and the brush module 200 illustrated in FIG. 4 is released. FIG. 12 is a cross-sectional view taken along line B-B of FIG. 11

As illustrated in FIG. 11, a button 130 is movably mounted on the housing 100. The button 130 may be mounted on the housing so as to be movable in a third direction D3. The third direction D3 may be a direction perpendicular to both the first direction D1 and the axial direction.

A first protrusion 131 is formed on the button 130. As the button 130 is moved, the first protrusion 131 is selectively positioned in the movement path in the first direction D1 of the second protrusion 221B.

The first protrusion 131 protrudes in the axial direction. The first protrusion 131 forms a first surface 131F inclined with respect to the first direction D1. As described above, the second protrusion 221B forms the second surface 221F inclined with respect to the first direction D1. The first surface 131F and the second surface 221F form an inclined contact surface.

As illustrated in FIG. 12, an elastic member 115 is provided in the housing 100. The elastic member 115 generates a resilience for pushing the first protrusion 131 in the movement path in the first direction D1. The elastic member 115 may be formed as a compression spring.

The coupling between the housing 100 and the brush module 200 is performed in the following order. In the state illustrated in FIG. 5, the user inserts the rotating brush 210 into the entrance 110A of the main body housing 110 while gripping the detachable cover 220. The user moves the rotating brush 210 toward the first shaft 310 while gripping the detachable cover 220.

FIGS. 4, 11, and 12 illustrate a state in which the second shaft 213 of the rotating brush 210 is fitted into the first shaft 310. When the second shaft 213 of the rotating brush 210 is fitted into the first shaft 310, the protrusion 222P is inserted into the insertion groove 110B. An inner surface of the insertion groove 110B constrains rotation of the slider 222 about the rotation axis.

In addition, when the second shaft 213 of the rotating brush 210 is fitted into the first shaft 310, the slider 222 is inserted into the entrance 110A. The inner surface of the entrance 110A and the inner surface of the insertion groove 110B constrain movement of the slider 222. Accordingly, even when the detachable cover 220 moves in the first direction D1, the rotating brush 210 continues to be in engagement with the first shaft 310.

As illustrated in FIGS. 11 and 12, in a state which the second shaft 213 of the rotating brush 210 is fitted into the first shaft 310, the insertion holes 113 are spaced apart from the leading-in member 221A2 in the first direction D1. The latching groove 114 is also spaced apart from the third protrusion 221C in the first direction D1.

When the user moves the detachable cover 220 in the first direction D1, the second protrusion 221B moves in the first direction D1 to form an inclined contact surface with the first protrusion 131. The inclined contact surface refers to a contact surface between the first surface 131F and the second surface 221F.

The button 130 is mounted on the housing 100 to be movable in the third direction D3. Accordingly, the second protrusion 221B pushes the first protrusion 131 in the third direction D3 through the inclined contact surface. As a result, in the process of the user moving the detachable cover 220 in the first direction D1, the first protrusion 131 is pushed outside the movement path in the first direction D1 of the second protrusion 221B.

Figure 13:
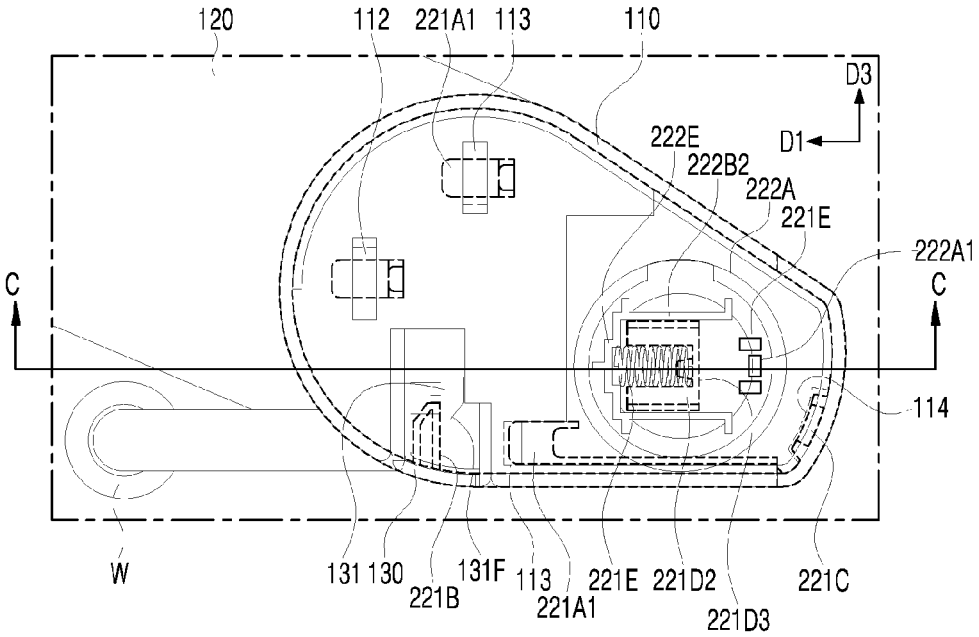
FIG. 13 is a partial perspective view illustrating a state in which the housing and the brush module illustrated in FIG. 3 are coupled to each other.
Figure 14:
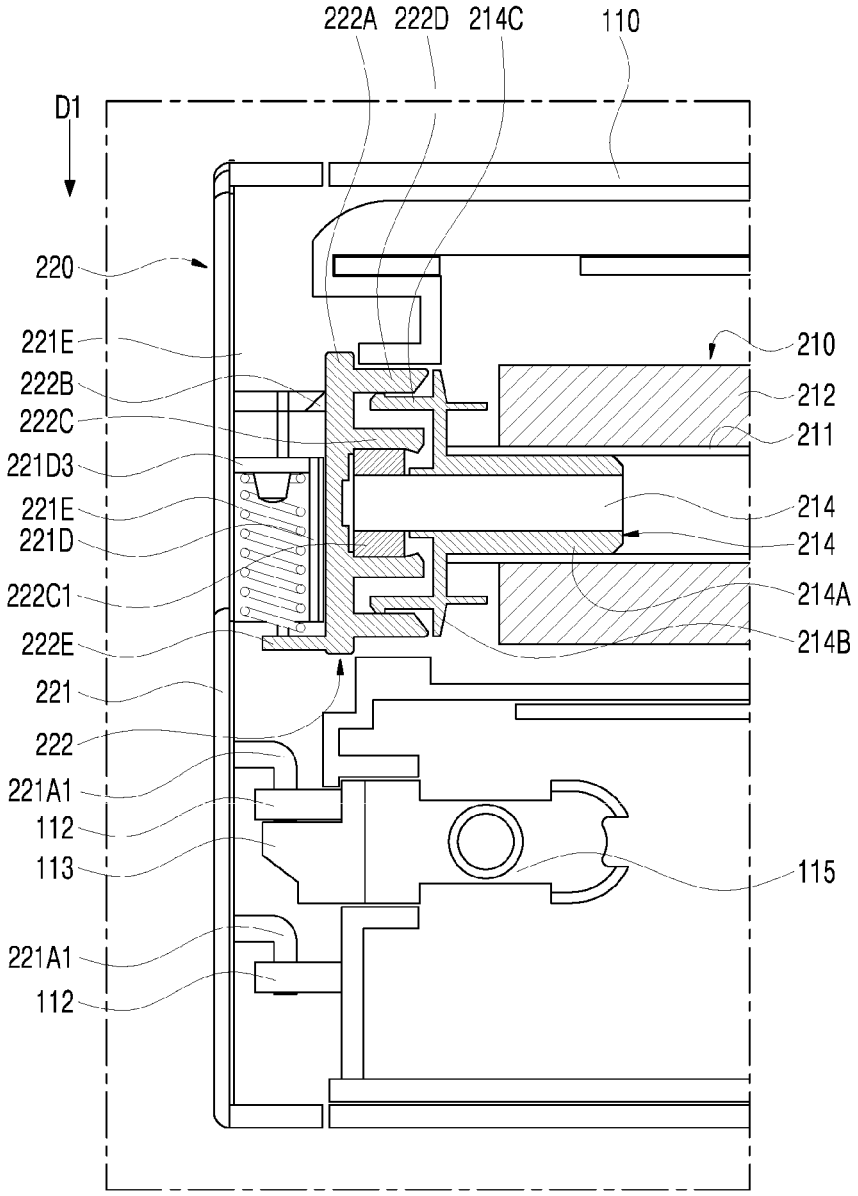
FIG. 14 is a cross-sectional view taken along line C-C of FIG. 13.

FIG. 13 is a partial perspective view illustrating a state in which the housing 100 and the brush module 200 illustrated in FIG. 3 are coupled to each other. FIG. 14 is a cross-sectional view taken along line C-C of FIG. 13

As illustrated in FIGS. 13 and 14, in this process, the leading-in members 221A2 are inserted into the insertion holes 113 in the first direction D1. The third protrusion 221C is inserted into the latching groove 114 in the first direction D1. When the rail 221D moves in the first direction D1, the elastic member 221E is compressed.

When the second protrusion 221B passes the first protrusion 131, the first protrusion 131 is positioned in the movement path in the first direction D1 of the second protrusion 221B by the resilience of the elastic member 115. The elastic member 221E generates a resilience for pushing the detachable cover 220 in the second direction. However, the second protrusion 221B does not move in the second direction due to the blocking by the first protrusion 131.

Thus, the coupling between the housing 100 and the brush module 200 is completed. In this state, the detachable cover 220 covers the coupling surface of the main body housing 110.

Separation of the brush module 200 from the housing 100 is performed in the following order.

When the user presses the button 130 in the third direction D3 in the state illustrated in FIG. 13, the first protrusion 131 moves in the third direction D3 to deviate from the movement path in the first direction D1 of the second protrusion 221B. The elastic member 221E generates a resilience for pushing the detachable cover 220 in the second direction.

As shown in FIG. 11, the detachable cover 220 moves in the second direction by the resilience of the elastic member 221E. The detachable cover 220 moves in the second direction until the rail 221D comes into contact with the limiting member 222A1.

At this time, the leading-in members 221A2 are separated from the insertion holes 113 in the second direction by the force of the elastic member 221E. In addition, the third protrusion 221C is separated from the latching groove 114 in the second direction.

In this state, the user may take out the rotating brush 210 from the entrance 110A of the main body housing 110 while gripping the detachable cover 220. Thus, the separation of the brush module 200 from the housing 100 is completed.

While the present disclosure has been explained in relation to its preferred embodiments, it is to be understood that various modifications thereof will become apparent to those skilled in the art upon reading the specification. Therefore, it is to be understood that the disclosure disclosed herein is intended to cover such modifications as fall within the scope of the appended claims.

The vacuum cleaner according to the embodiments of the present disclosure is industrially applicable in that since the housing and the detachable cover may be coupled to each other at a plurality of points by inserting the insertion members formed in the detachable cover into the insertion holes formed in the housing, loosening between the detachable cover and the housing due to the axial force applied to the rotating brush can be minimized.

What is claimed is:

1. A vacuum cleaner, comprising:

a main body configured to generate an air pressure difference;

a suction nozzle configured to suck up dust on a cleaning surface through the generated air pressure difference, the suction nozzle including:

a housing including:

an insertion hole;

a passage through which the dust moves to the main body; and a button including a first protrusion;

a detachable cover attached to the housing, the detachable cover including:

a second protrusion; and an insertion member configured to be inserted into the insertion hole in a first direction; and a rotating brush configured to rotate so as to push the dust on the cleaning surface toward the passage, the rotating brush being rotatably mounted to the detachable cover, wherein the button is movably mounted on the housing to selectively position the first protrusion in a movement path in the first direction of the second protrusion, wherein movement of the button causes the detachable cover to disengage from the housing, and wherein the housing includes an elastic member for pushing the first protrusion in the movement path in the first direction.

2. The vacuum cleaner according to claim 1, wherein the second protrusion is moveable in the first direction and forms an inclined contact surface with the first protrusion, and wherein the second protrusion is configured to push the first protrusion outside the movement path in the first direction of the second protrusion through the inclined contact surface.

3. The vacuum cleaner according to claim 1, wherein the first direction is a direction perpendicular to a direction of a rotation axis of the rotating brush, and wherein an inner surface of the insertion hole forms movement and rotation boundaries that prevent movement and rotation of the insertion member except for movement in the movement path in the first direction of the second protrusion.

4. The vacuum cleaner according to claim 3, wherein the detachable cover further includes:

a cover body including:

the insertion member;

the second protrusion; and a rail; and a slider mounted on the rail so as to be movable in the first direction, and wherein the rotating brush is rotatably mounted to the slider.

5. The vacuum cleaner according to claim 4, wherein the rail includes an elastic member for providing a force in the first direction to the slider, and wherein, when the first protrusion deviates from the movement path in the first direction of the second protrusion, the insertion member is separated from the insertion hole in a second direction opposite to the first direction by the force applied by the elastic member.

6. The vacuum cleaner according to claim 4, wherein the housing further includes:

a first shaft rotatably mounted to the housing; and a driver configured to rotate the first shaft, wherein the first shaft is engaged with the rotating brush and is configured to rotate the rotating brush, and wherein, even when the cover body moves in the first direction, the rotating brush continues to be in engagement with the first shaft.

7. The vacuum cleaner according to claim 6, wherein the housing includes an entrance through which the rotating brush passes toward the first shaft, and wherein an inner surface of the entrance constrains rotation of the slider about the rotation axis.

8. The vacuum cleaner according to claim 1, wherein the housing further includes a latching groove, wherein the detachable cover includes a third protrusion, and wherein the third protrusion is inserted into the latching groove in the first direction.

9. The vacuum cleaner according to claim 8, wherein the latching groove is formed on an opposite side of the insertion hole based on the rotation axis, and wherein an inner surface of the latching groove forms a movement boundary that prevents movement of the third protrusion in the first direction and in the direction of the rotation axis.

10. A vacuum cleaner, comprising:

a main body configured to generate an air pressure difference; and a suction nozzle configured to suck up dust on a cleaning surface through the generated air pressure difference, the suction nozzle including:

a housing including:

an insertion hole;

a passage through which the dust moves to the main body;

a button having a first protrusion;

a first shaft rotatably mounted to the housing; and a driver configured to rotate the first shaft;

a cover body including:

a rail;

a second protrusion; and an insertion member configured to be inserted into the insertion hole in a first direction;

a slider mounted on the rail so as to be movable in the first direction; and a rotating brush rotatably mounted to the slider, the first shaft being configured to rotate the rotating brush, wherein the button is movably mounted on the housing to selectively position the first protrusion in a movement path in the first direction of the second protrusion, wherein movement of the button causes the cover body to disengage from the housing, wherein the second protrusion is movable in the first direction and forms an inclined contact surface with the first protrusion, and wherein the second protrusion is configured to push the first protrusion outside the movement path in the first direction of the second protrusion through the inclined contact surface.

11. The vacuum cleaner according to claim 10, wherein the rail includes an elastic member for providing a force in the first direction to the slider, and wherein, when the first protrusion deviates from the movement path in the first direction of the second protrusion, the insertion member is separated from the insertion hole in a second direction opposite to the first direction by the force applied by the elastic member.

12. The vacuum cleaner according to claim 10, wherein, even when the cover body moves in the first direction, the rotating brush continues to be in engagement with the first shaft.

13. The vacuum cleaner according to claim 10, wherein the rotating brush includes:

a cylindrical body;

a brush attached to an outer surface of the cylindrical body;

a second shaft coupled to a first side of a rotation axis of the cylindrical body; and a third shaft coupled to a second side of the rotation axis of the cylindrical body.

14. The vacuum cleaner according to claim 13, wherein the first shaft includes a plurality of grooves, wherein the second shaft includes a plurality of projections that engage the plurality of grooves of the first shaft, and wherein a rotating force of the first shaft is transmitted to the rotating brush through the second shaft.

15. The vacuum cleaner according to claim 14, wherein the third shaft rotatably couples the cylindrical body to the slider.

* * * * *